US009171406B2

(12) United States Patent
Carpenter

(10) Patent No.: US 9,171,406 B2
(45) Date of Patent: Oct. 27, 2015

(54) OFFLINE EXCEPTION PROCESSING OF MAIL

(75) Inventor: Michael Carpenter, Arlington, TX (US)

(73) Assignee: Siemens Industry, Inc., Alpharetta, GA (US)

( * ) Notice: Subject to any disclaimer, the term of this patent is extended or adjusted under 35 U.S.C. 154(b) by 736 days.

(21) Appl. No.: 13/441,170

(22) Filed: Apr. 6, 2012

(65) Prior Publication Data

US 2013/0131860 A1 May 23, 2013

Related U.S. Application Data

(60) Provisional application No. 61/561,664, filed on Nov. 18, 2011.

(51) Int. Cl.
*G07F 7/00* (2006.01)
*G07B 17/00* (2006.01)

(52) U.S. Cl.
CPC .. *G07B 17/00467* (2013.01); *G07B 2017/0004* (2013.01); *G07B 2017/00443* (2013.01); *G07B 2017/00475* (2013.01); *G07B 2017/00556* (2013.01); *G07B 2017/00709* (2013.01)

(58) Field of Classification Search
None
See application file for complete search history.

(56) References Cited

U.S. PATENT DOCUMENTS

| | | | | |
|---|---|---|---|---|
| 7,104,451 | B1 * | 9/2006 | McCartney | 235/462.01 |
| 2006/0080266 | A1 * | 4/2006 | Kiani et al. | 705/402 |
| 2007/0165208 | A1 * | 7/2007 | Cowburn et al. | 356/71 |

* cited by examiner

*Primary Examiner* — Yolanda Cumbess

(57) ABSTRACT

Mail processing systems and methods. A method includes scanning a plurality of mail pieces in a first processing step to produce mail piece images. The method includes producing a template based on a plurality of the mail piece images and associating a plurality of mail pieces with the template, the associated plurality of mail pieces forming a mail set. The method includes identifying quality-control problems associated with the mail set, separating the mail set from other mail during a second processing step, and separately processing the mail set from the other mail.

16 Claims, 3 Drawing Sheets

OFFLINE EXCEPTION PROCESSING OF MAIL

CROSS-REFERENCE TO RELATED APPLICATIONS

The following applications are incorporated by reference: U.S. Provisional Patent Application 61/306,592, filed Feb. 22, 2010, and U.S. patent application Ser. No. 13/031,884, filed Feb. 22, 2011. This application claims the benefit of the tiling date of U.S. Provisional Patent Application 61/561,664, filed Nov. 18, 2011, which is hereby incorporated by reference.

TECHNICAL FIELD

The present disclosure is directed, in general, to processing of mail, including bulk mail and other mail pieces or parcels.

BACKGROUND OF THE DISCLOSURE

Improved systems for tracking and accounting for mail pieces is desirable.

SUMMARY OF THE DISCLOSURE

Various disclosed embodiments include a system and method. A method includes scanning a plurality of mail pieces in a first processing step to produce mail piece images. The method includes producing a template based on a plurality of the mail piece images and associating a plurality of mail pieces with the template, the associated plurality of mail pieces forming a mail set. The method includes identifying quality-control problems associated with the mail set, separating the mail set from other mail during a second processing step, and separately processing the mail set from the other mail.

The foregoing has outlined rather broadly the features and technical advantages of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Before undertaking the DETAILED DESCRIPTION below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software, or some combination of at least two of the same. It should be noted that the functionality associated with any particular controller may be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

Figure 1:
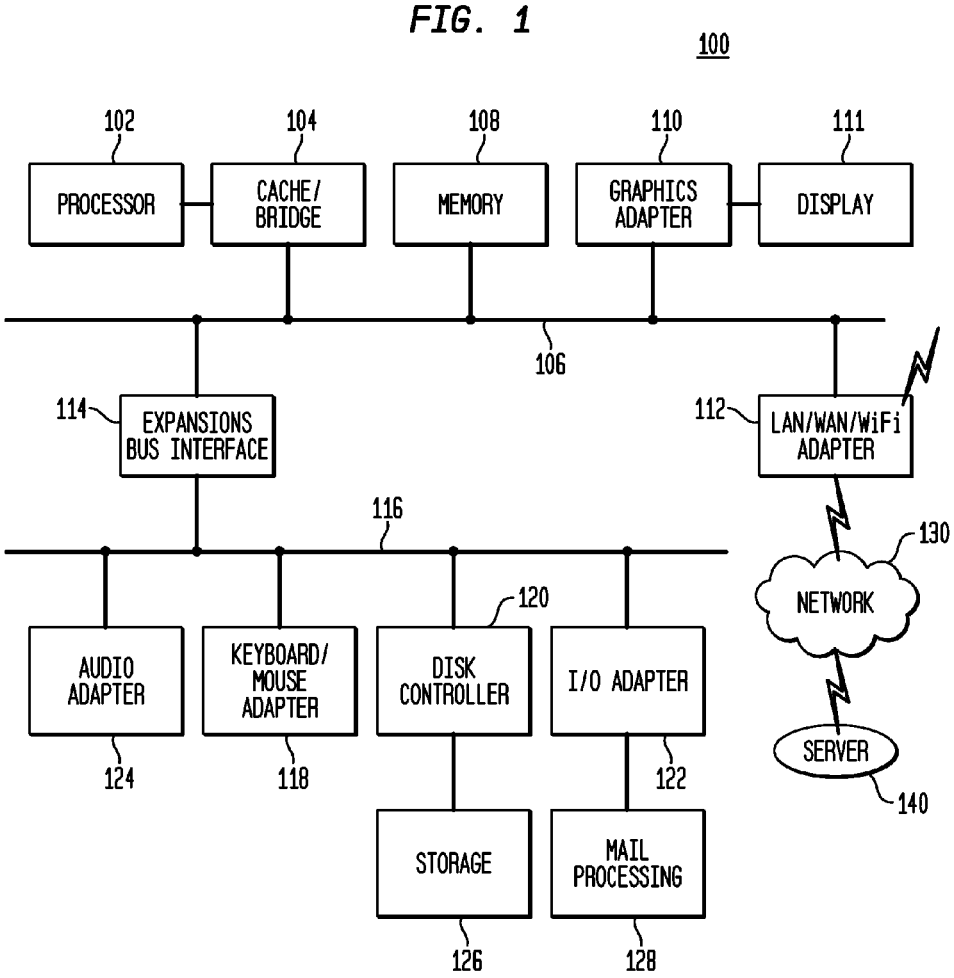
FIG. 1 depicts a block diagram of a data processing system in which an embodiment can be implemented.
Figure 2A:
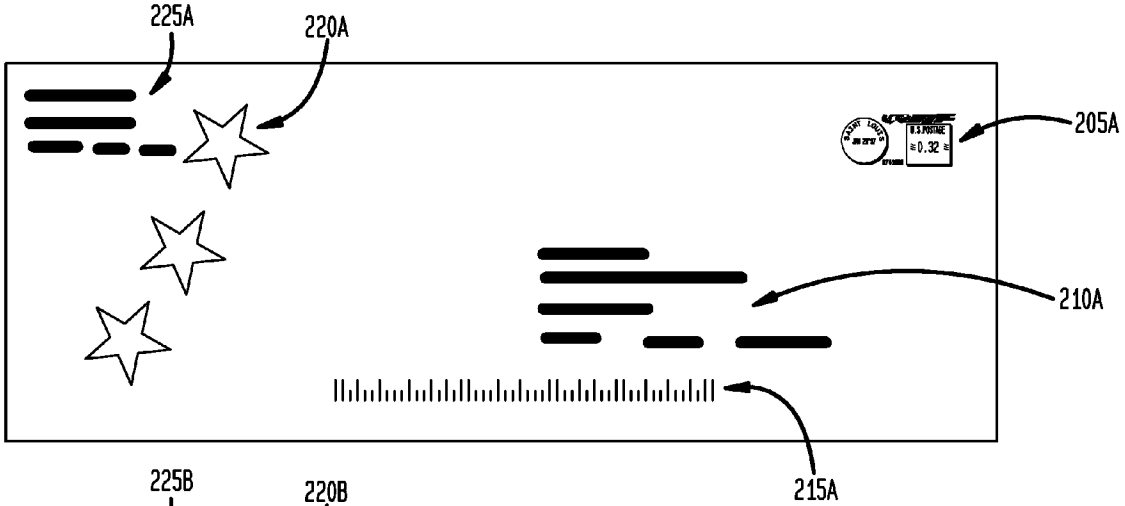
FIGS. 2A and 2B illustrate examples of mail items with different fingerprints but similar features that can be used to determine a template in accordance with disclosed embodiments.
Figure 2B:
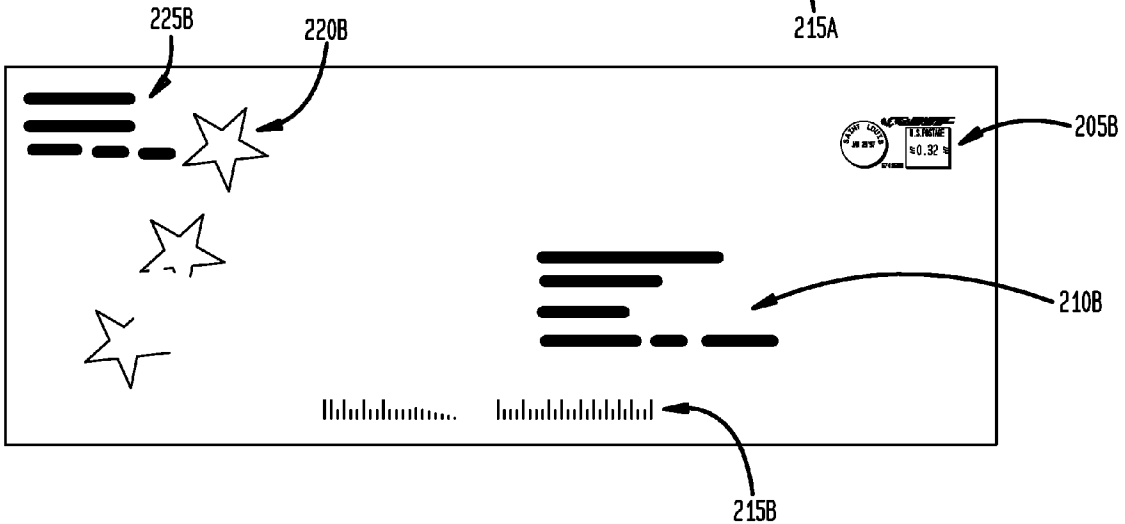
Figure 3:
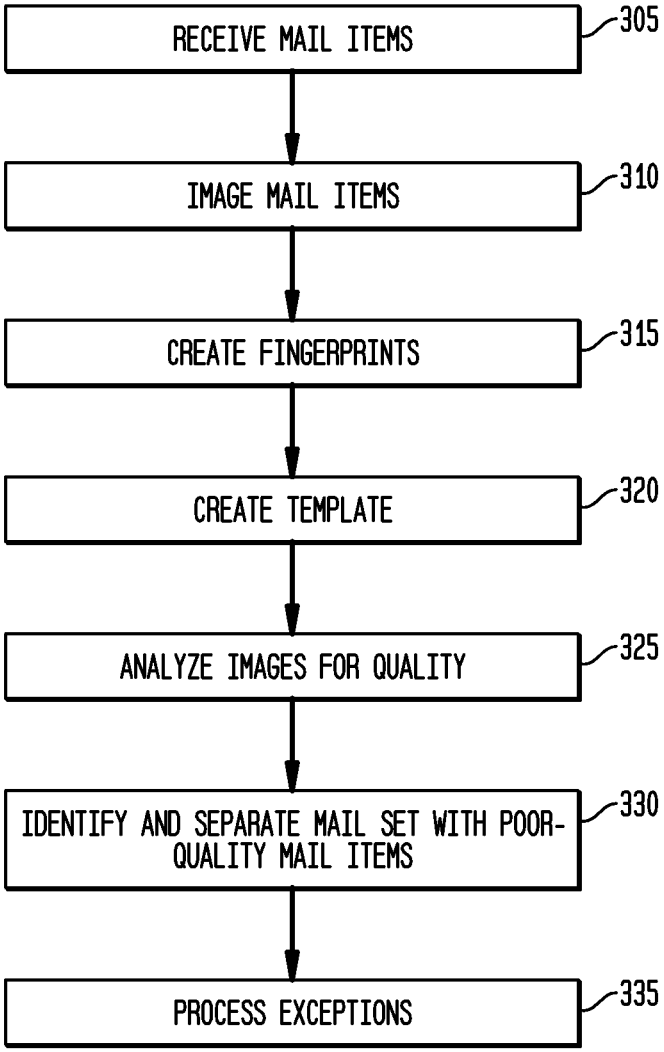
FIG. 3 depicts a flowchart of a process in accordance with disclosed embodiments.

FIGS. 1-3, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. The numerous innovative teachings of the present application will be described with reference to exemplary non-limiting embodiments.

Disclosed embodiments include systems and methods for a seamless acceptance process through which the preparation quality of postal mailings is validated, and exceptions that do not meet the standard of quality can be separated coincident with multiple pass sortation.

Postal agencies have introduced "work sharing" programs whereby mass mailers introduce batches of mail deeply into the postal distribution network, toward the destination, so that the processing costs of the postal agency can be greatly reduced, and a portion of this savings can be passed along to the originator in the form of discounts on the delivery fee. The deepest discounts are offered in cases in which the mail is injected at the final processing step.

Since a significant portion of the postal agencies processing steps are bypassed through work sharing, it is important that the mailpieces introduced deeply into the system have been prepared to at least the same level and quality standards as the mailpieces that undergo the entire postal agency process. Otherwise, this savings potential is lost in the exception processing of improperly prepared mailpieces, for which a discounted delivery fee was not completely justified.

To ensure that mail for which discounts are offered is prepared according to the prerequisite standards, technical solutions have been utilized whereby the quality of a batch of mail from the same originator is determined through statistical sampling using various means. Alternative approaches to quality checking actually induct batches of mail without first validating their adherence to preparation requirements. In these approaches, the mail processing systems that perform the final processing step, preparing mail for delivery, perform quality checking of mail. This final processing step is multiple pass sequence sorting.

In multiple-pass sequence sorting, mail items that have passed through a upstream postal process are aggregated with workshare items that have otherwise been processed and prepared, and are radix sorted by certain address keys into a physical array, collected in sequence, and then sorted again by different specific address keys into the physical array. In such a two-pass sorting operation, the maximum number of sorting destinations is equivalent to the size of the first pass array times the size of the second pass array. With such an abundance of potential sorting destinations, it is possible to sort the mail items into the order in which they will be delivered.

In quality checking approaches that occur concurrently with multiple-pass sequence sorting (rather than in an explicit, sample-based examination prior to processing), validating discrepancies in the preparation quality can be problematic, especially when the analysis is done offline. By the time analysis is complete, the physical mail items have already been sorted according to delivery requirements, and it is no longer possible to associate specific information regarding quality problems to specific mail items.

The quality problems among the mail batches are therefore processed and delivered despite their inferior quality of preparation. This often leads to additional costs that the postal agency must incur in the processing, handling, and delivery. For example, the barcodes used to identify mail items and their destination must be readable to allow automatic processing, and justify any discount given to the mailer. When barcodes are of poor quality and are not read, the mail is processed at a much higher cost than the standard rate for a deeply discounted price.

FIG. 1 depicts a block diagram of a data processing system in which an embodiment can be implemented, for example, as one of the systems or servers described below, and can be configured to perform processes as described herein. The data processing system depicted includes a processor 102 connected to a level two cache/bridge 104, which is connected in turn to a local system bus 106. Local system bus 106 may be, for example, a peripheral component interconnect (PCI) architecture bus. Also connected to local system bus in the depicted example are a main memory 108 and a graphics adapter 110. The graphics adapter 110 may be connected to display 111.

Other peripherals, such as local area network (LAN)/Wide Area Network/Wireless (e.g. Win) adapter 112, may also be connected to local system bus 106. Expansion bus interface 114 connects local system bus 106 to input/output (I/O) bus 116. I/O bus 116 is connected to keyboard/mouse adapter 118, disk controller 120, and I/O adapter 122. Disk controller 120 can be connected to a storage 126, which can be any suitable machine usable or machine readable storage medium, including but not limited to nonvolatile, hard-coded type mediums such as read only memories (ROMs) or erasable, electrically programmable read only memories (EEPROMs), magnetic tape storage, and user-recordable type mediums such as floppy disks, hard disk drives and compact disk read only memories (CD-ROMs) or digital versatile disks (DVDs), and other known optical, electrical, or magnetic storage devices. I/O adapter 122 can also be connected, in some embodiments, to mail processing equipment 128, either as known to those of skill in the art or configured to perform as described herein, and can include barcode scanners for scanning barcode labels on mail pieces, scanning and imaging equipment, mail sorting and transport equipment, and other mail processing systems and devices.

Also connected to I/O bus 116 in the example shown is audio adapter 124, to which speakers (not shown) may be connected for playing sounds. Keyboard/mouse adapter 118 provides a connection for a pointing device (not shown), such as a mouse, trackball, trackpointer, etc.

Those of ordinary skill in the art will appreciate that the hardware depicted in FIG. 1 may vary for particular implementations. For example, other peripheral devices, such as an optical disk drive and the like, also may be used in addition or in place of the hardware depicted. The depicted example is provided for the purpose of explanation only and is not meant to imply architectural limitations with respect to the present disclosure.

A data processing system in accordance with an embodiment of the present disclosure can include an operating system employing a graphical user interface. The operating system permits multiple display windows to be presented in the graphical user interface simultaneously, with each display window providing an interface to a different application or to a different instance of the same application. A cursor in the graphical user interface may be manipulated by a user through the pointing device. The position of the cursor may be changed and/or an event, such as clicking a mouse button, generated to actuate a desired response.

One of various commercial operating systems, such as a version of Microsoft Windows™, a product of Microsoft Corporation located in Redmond, Wash. may be employed if suitably modified. The operating system is modified or created in accordance with the present disclosure as described.

LAN/WAN/Wireless adapter 112 can be connected to a network 130 (not a part of data processing system 100), which can be any public or private data processing system network or combination of networks, as known to those of skill in the art, including the Internet, LAN/WAN/Wireless adapter 112 can also perform other data processing system or server processes described herein. Data processing system 100 can communicate over network 130 with one or more server systems 140, which are also not part of data processing system 100, but can be implemented, for example, as separate data processing systems 100.

A "mail processing system", as used herein, can include one or more data processing systems, acting individually or collectively, and can include or be connected to appropriate hardware to perform other mail processing functions, such as sorting, scanning, printing, etc. Such additional hardware is known to those of skill in the art, and so any combination of the data processing system hardware and mail processing hardware as described herein, configured to perform processes as described herein, is intended to be within the scope of this disclosure.

According to disclosed embodiments, an innovative identification technique, referred to as a "fingerprint," is used to correlate information regarding preparation quality problems to physical mail items in an offline process between the first and second sequence sorting passes. This approach allows mailers to be presented with the quality problems within their mail batches, protects the revenue of the postal agency, and precludes most of the cost that the postal agency would otherwise incur processing and delivering mail that is not properly prepared.

During the first pass of multiple pass sequence sorting, images of every mail item are collected as the mail is processed, coincident with recognition processes needed to correctly sort the mail. These images may also be retained centrally or locally for alternative purposes, including offline quality checking. Offline quality checking of the images identifies the adequacy of various information found on the mailpiece, including address completeness and accuracy, text and barcode legibility, and postage.

"Fingerprint," in this case, refers to a technology that allows mail items to be uniquely re-identified based on various graphical features, including text blocks, colors, shapes, locations, pictures and other visually distinctive items, or other graphical features that can be identified and recorded from a mail item image. This fingerprint allows the individual mail items to be re-identified by comparison to its fingerprint, and without requiring that a unique identifying serial number be applied to the mail items, in text, barcode, or otherwise. Fingerprint is useful when it is necessary to correlate information about an item with the physical item itself without unique barcodes. One product that can implement such fingerprint techniques is the Siemens ARTid™ product.

No two mail items are exactly alike in terms of their optical or graphical features, even within a batch of substantially-identical mail items. The mail item fingerprint can uniquely identify the specific fingerprint. A group of mail substantially-identical mail items, such as a common bulk mailing, will have enough common features such that the general placement, size, and relation of the graphical features can be used to build a template of common features that can be used to identify the mail items in a bulk mailing.

FIGS. 2A and 2B illustrate examples of mail items with different fingerprints but similar features that are used to determine a template in accordance with disclosed embodiments. For example, the placement of the respective meter stamps 205A and 205B are generally the same, and so could be used as a template fixture, but the meter stamp 205B is slightly askew as compared to meter stamp 205A, so these mail items can be distinguished from each other. Address blocks 210A and 210B are commonly located on the respective mail items, but have different shapes of the text areas, and the text itself could be checked. Bar codes 215A and 215B are commonly located, but have different shapes, and bar code 215B shows a printing error, which can be a significant quality issue that affects processing. The decorative stars 220A and 220B are commonly located, but stars 220B also show a printing error. Return-address blocks 225A and 225B appear identical.

The common features of the mail items, including the locations of the meter stamps, postage, indicia, address blocks, bar codes, decorative items, and return-address block, can be used to create a template that can be used to identify all other mail items that share those features, such as the mail items in a hulk mailing. The combination of the specific features, differences, and defects of these same features are used to create the fingerprint for each mail item, which can be used to re-identify the same mail item at a later processing stage.

Any type of mail item, including letters, flats, and parcels, can be imaged and identified using fingerprints and templates as described herein.

Disclosed embodiments include processes that take advantage of fingerprints and templates to perform "offline" processing of mail item image data to perform quality checking. As used herein, "online" refers to processes performed by a sequencer, sorter, or similar device while the physical mail items are actually being processed, and "offline" refers to processes that are performed between the online processing tasks or by a system or equipment other than the sequencer or sorter.

During the first processing of a batch of bulk mail, a template of features is made for each mail item. In subsequent processing of the mail items, newly collected features may be compared to the original template to determine which mail items match the template. The template can include an identification of features such as graphics, text, address labels or blocks, or specific elements of each of these, and their relative positions on each mail item, as described herein.

Utilizing the fingerprints together with the offline quality checking allows fingerprint templates to be associated with the results of a quality checking process from the first pass of the multiple-pass sequence sorting. That is, the system can identify the overall quality of the bulk mailing and associate it with the template it has created for that batch of mail.

Later, during a second pass, the each mail item can be re-imaged to associate it with its stored fingerprint and to associate it with the templates from the first pass. At this point, the quality-checking results can be attributed to physical mail items "online" in the second pass. This allows for mail items for which a predetermined number, type, and severity of quality problems have been identified to be specially sorted for unique exception processing. Such mail items that match a template with a poor quality score can be removed from the standard mail processing flow for exception processing.

Depending on customer service agreements, exceptions in the quality checking process can either be upgraded to higher postage to justify the higher potential cost of attempting delivery, or their delivery can be cancelled and they can be treated as waste, or other exception processing can be performed. Other variations in customer service agreements would allow the sender to be presented with physical evidence of the quality problems, for example, by transmitting mail item images to the customer, which may be necessary because of the implied loss of discount or incomplete delivery.

In some embodiments, the system can mark exception mail items with a unique serial number in human-readable characters and/or barcodes, as well as quality exception classes. In addition, in some embodiments, the system can rework quality problems such that the associated mail items can be delivered without difficulty. These processes can occur in a subsequent automation operation whereby the images of quality exception mail items are lifted, fingerprint features are generated, and the association between the individual quality exception mail items is made to the detailed quality information regarding the specific items. Labels may be automatically placed on the mail items, and unique identifiers, exception information, and corrected delivery information can be printed on the labels.

FIG. 3 depicts a flowchart of a process in accordance with disclosed embodiments. In this figure, solid boxes are used to represent "online" processes, and dotted-line boxes are used to represent "offline" processes. The term "system" is used below to describe the mail processing equipment and data processing systems that perform the various steps, that can be implemented as one or more data processing systems 100, servers 140, and mail processing equipment 128, which can include scanner, sequencers, sorters, and other mail processing and transport equipment.

The system receives mail items, such as discounted "workshare" mail of unknown quality or a similar bulk mailing (step 305).

The system scans or otherwise images each mail item to produce mail item images (step 310). This first-pass processing step can also include sorting or other processes.

The system can create a fingerprint of each mail item from the respective mail item image (step 315). This can be performed, for example, using the Siemens ARTid™ product. The respective mail fingerprint can be used to uniquely identify each mail piece as each mail piece is processed.

The system can create a mail item template from a plurality of mail item images (step 320). This can be performed, for example, using the Siemens ARTid™ product to produce an ARTid template, or can be used to produce another fingerprint template. The mail item template can be a template that identifies multiple mail items based on common or similar characteristics of their individual fingerprints. These multiple mailpieces can be determined to be part of the same mailing from the same sender, based on these characteristics, which can be referred to as a "mail set". This step can include associating the plurality of mail items and their mail item images and fingerprints with the mail item template; the template likewise associated with the mail set. Note that because the received mail items may include multiple different batches of mail with different quality, there may be multiple templates produced at this point, each associated with a different plurality of mail items.

The system analyzes the mail item images of the mail set to produce quality data for the mail set (step 325). This can be performed, in some cases, by sending the mail item images and ARTid™ template or fingerprint template of each mail item to a local quality control server, which analyzes it to produce ARTid™ quality assurance data. Also at this time, the comingled mail of mixed quality can be transported for a second processing. The template is used to identify mail sets for which the quality data indicates that there is a higher number of quality-control problems with individual mail pieces, referred to as "poor quality mail items" or "exceptions," as opposed to "quality" mail with few quality-control problems.

The system can perform a second-pass processing step that includes identifying and separating the mail pieces for a mail set with poor-quality mail items (step 330). This step can include re-imaging each mail item, and using the image to identify the template and mail set associated with each mail item. This step can include sending "quality" mail for delivery, and removing poor-quality mail items from the standard mail processing flow (or otherwise separating the poor-quality mail set from the other mail items). This can include sending the exceptions to an off-line handling process. This can include sending the mail pieces for mail sets poor quality mail items to a separate exception-handling output for off-line handling so that they are no longer processed with the higher-quality mail pieces.

The system can process the exceptions using the template and image to attempt to correct the quality problems (step 335), such as correcting addressing information and otherwise. This can be performed in an optional labeling and rework pass. This can be performed by the system, or the mail items can be returned so this step can be performed by the original mailer or another processor. The quality-corrected or upgraded mad can then be delivered.

In various embodiments, various ones of the steps above may be performed sequentially, concurrently, in a different order, or omitted, unless otherwise specifically claimed. In particular, various steps can be performed at different locations or by different parties using separate or interconnected mail processing systems, and so only specific steps may be performed at a certain time or by a specific party or system.

Those skilled in the art will recognize that, for simplicity and clarity, the full structure and operation of all systems suitable for use with the present disclosure is not being depicted or described herein. Instead, only so much of the physical systems as is unique to the present disclosure or necessary for an understanding of the present disclosure is depicted and described. The remainder of the construction and operation of the systems disclosed herein may conform to any of the various current implementations and practices known in the art.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs). In particular, computer readable mediums can include transitory and non-transitory mediums, unless otherwise limited in the claims appended hereto.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, or function is an essential element which must be included in the claim scope: the scope of patented subject matter is defined only by the allowed claims. Moreover, none of these claims are intended to invoke paragraph six of 35 USC §112 unless the exact words "means for" are followed by a participle.

What is claimed is:

1. A method, comprising:

scanning a plurality of mail pieces in a first processing step, by mail processing equipment, to produce mail piece images;

creating a mail piece fingerprint corresponding to each mail piece image, wherein each mail piece fingerprint uniquely identifies the corresponding mail piece based on graphical features of the corresponding mail piece including text blocks, colors, shapes, locations, pictures, or other visually distinctive items, without applying any identifier to the mail piece;

producing a template based on a plurality of the mail piece images;

associating a plurality of mail pieces with the template, the associated plurality of mail pieces forming a mail set;

identifying quality-control problems associated with the mail set;

separating the mail set from other mail during a second processing step by using the mail piece fingerprints to identify mail pieces that are part of the mail set; and separately processing the mail set from the other mail.

2. The method of claim 1, wherein the first processing step and the second processing step also include sorting the mail items.

3. The method of claim 1, wherein the respective mail fingerprint is used to uniquely identify each mail piece as each mail piece is processed.

4. The method of claim 1, wherein separating the mail set is performed by comparing mail piece images to the template to identify mail pieces that are part of the mail set.

5. The method of claim 1, wherein the producing, associating, and identifying steps are performed as offline processes.

6. The method of claim 1, wherein mail items that are not associated with the mail set associated with quality-control problems are sent for delivery.

7. The method of claim 1, wherein separately processing the mail set includes correcting quality problems.

8. The method of claim 1, wherein the template is based on common features of the mail items, including locations of meter stamps, postage, address blocks, bar codes, decorative items, or return-address block.

9. A mail processing system, comprising:

at least one processor;

an accessible memory; and mail processing equipment, the mail processing system configured to scan a plurality of mail pieces in a first processing step, by mail processing equipment, to produce mail piece images;

create a mail piece fingerprint corresponding to each mail piece image, wherein each mail piece fingerprint uniquely identifies the corresponding mail piece based on graphical features of the corresponding mail piece including text blocks, colors, shapes, locations, pictures, or other visually distinctive items, without applying any identifier to the mail piece;

produce a template based on a plurality of the mail piece images;

associate a plurality of mail pieces with the template, the associated plurality of mail pieces forming a mail set;

identify quality-control problems associated with the mail set;

separate the mail set from other mail during a second processing step by using the mail piece fingerprints to identify mail pieces that are part of the mail set; and separately process the mail set from the other mail.

10. The mail processing system of claim 9, wherein the first processing step and the second processing step also include sorting the mail items.

11. The mail processing system of claim 9, wherein the respective mail fingerprint is used to uniquely identify each mail piece as each mail piece is processed.

12. The mail processing system of claim 9, wherein separating the mail set is performed by comparing mail piece images to the template to identify mail pieces that are part of the mail set.

13. The mail processing system of claim 9, wherein the producing, associating, and identifying steps are performed as offline processes.

14. The mail processing system of claim 9, wherein separately processing the mail set includes correcting quality problems.

15. The mail processing system of claim 9, wherein the template is based on common features of the mail items, including locations of meter stamps, postage, address blocks, bar codes, decorative items, or return-address block.

16. A non-transitory computer readable medium having program instructions stored thereon executable by one or more processors to:

scan a plurality of mail pieces in a first processing stepto produce mail piece images;

create a mail piece fingerprint corresponding to each mail piece image, wherein each mail piece fingerprint uniquely identifies the corresponding mail piece based on graphical features of the corresponding mail piece including text blocks, colors, shapes, locations, pictures, or other visually distinctive items, without applying any identifier to the mail piece;

produce a template based on a plurality of the mail piece images;

associate a plurality of mail pieces with the template, the associated plurality of mail pieces forming a mail set;

identify quality-control problems associated with the mail set;

separate the mail set from other mail during a second processing step by using the mail piece fingerprints to identify mail pieces that are part of the mail set; and separately process the mail set from the other mail.

* * * * *